United States Patent [19]

Phillips et al.

[11] 4,059,332

[45] Nov. 22, 1977

[54] SNAP ACTION BREECH LOCK CONNECTOR

[75] Inventors: John J. Phillips, Rolling Hills; Roger Stephenson, Woodland Hills, both of Calif.

[73] Assignee: G & H Technology, Inc., Santa Monica, Calif.

[21] Appl. No.: 769,583

[22] Filed: Feb. 17, 1977

Related U.S. Application Data

[63] Continuation of Ser. No. 684,923, May 10, 1976, abandoned, which is a continuation of Ser. No. 487,000, July 10, 1974, abandoned.

[51] Int. Cl.[2] ..... H01R 13/54

[52] U.S. Cl. ..... 339/113 R; 339/89 M; 339/186 M

[58] Field of Search ..... 339/89, 90, 111, 113, 339/184–186; 340/248 R

[56] References Cited

U.S. PATENT DOCUMENTS

| | | | |
|---|---|---|---|
| 2,563,782 | 8/1951 | Uline et al. | 339/186 M |
| 3,196,424 | 7/1965 | Hardesty et al. | 339/113 L |
| 3,212,050 | 10/1965 | Stark | 339/90 C |
| 3,466,590 | 9/1969 | Sylvester | 339/186 M |
| 3,569,908 | 3/1971 | Appleton | 339/111 |
| 3,614,711 | 10/1971 | Anderson et al. | 339/186 M |
| 3,945,703 | 3/1976 | McCormick | 339/89 M |

FOREIGN PATENT DOCUMENTS

| | | | |
|---|---|---|---|
| 1,392,573 | 4/1975 | United Kingdom | 339/113 R |

*Primary Examiner*—Roy Lake
*Assistant Examiner*—E. F. Desmond
*Attorney, Agent, or Firm*—Thomas L. Flattery

[57] ABSTRACT

A multi-contact electrical connector having a plug section and a receptacle section is provided with a breech lock for releasably securing the separate sections of the connector together. Toggle action biasing means such as a conical disc spring and high lead threads with a predetermined amount of lost motion therein insure a "snap-action" mating and unmating of the two sections and the parts thereof as the breech lock is set and unset. This prevents a "false mating" and insures that the connector will always be either fully and completely mated or unmated. A short pin or remote mate monitor contact is included whereby the condition of the connector can be automatically and/or remotely monitored.

3 Claims, 6 Drawing Figures

SNAP ACTION BREECH LOCK CONNECTOR

Figure 1:
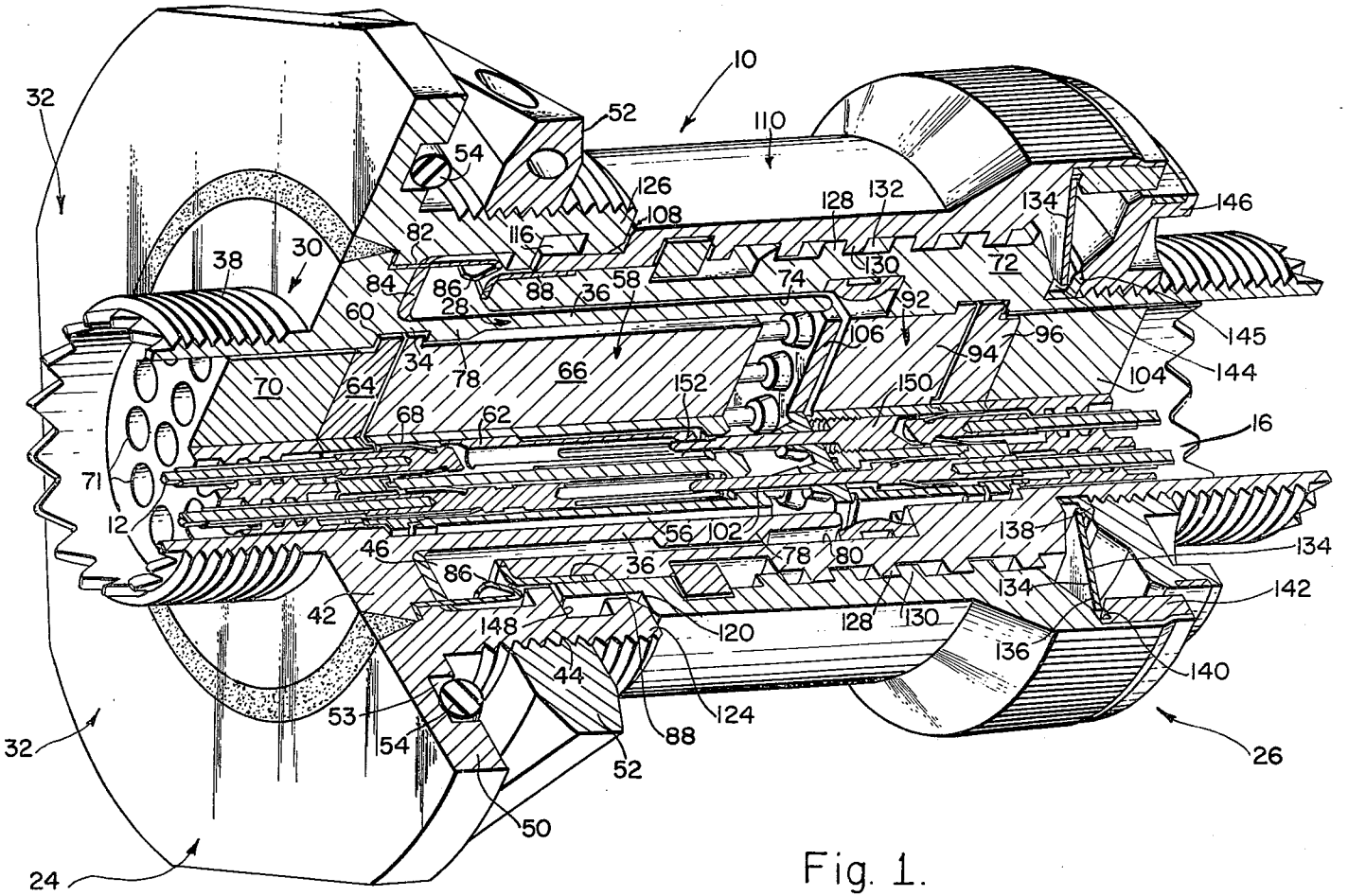

This is a continuation of application Ser. No. 684,923, filed May 10, 1976, now abandoned, which was a continuation of application Ser. No. 487,000, filed July 10, 1974, now abandoned.

BACKGROUND

In order to facilitate interconnecting the individual wires in a second cable, it has been proposed to use various types of multi-contact connectors. Many of these connectors have been satisfactory for their intended purposes. However, they have had various types of limitations which reduced their usefulness for some purposes. The most common types of the connector have usually been secured together by a threaded nut, etc. By screwing one or more of the parts, the connector sections are secured together or else released. This has required a considerable amount of manual manipulation to mate and release the sections. This is a time consuming operation and if the connector is located in an inaccessible location which is difficult to reach, the mating and threading together of the sections can be very difficult. In those connectors which have a large number of individual electrical contacts which must be forced together during mating, the loads on the individual parts of the sections have been high. As a consequence, some parts of the connector sections such as the locking mechanisms have failed prematurely. In addition, these large forces have made it difficult to fully mate all of the electrical contacts without the use of special tools, etc.

More recently it has been proposed to employ an improved connector of the type disclosed and claimed in copending application Ser. No. 326,460 entitled "SNAP ACTION CONNECTOR" filed Jan. 24, 1973 in the name of Larry L. McCormick and assigned of record to G & H Technology Inc. The Snap Action Connector utilizes a breech lock for securing the two sections together. In addition, a toggle biasing means such as a conical disc spring and a high lead thread with a predetermined amount of lost motion is provided. This has resulted in a connector which is much easier to mate and unmate the two sections and which insures a more effective electrical engagement of the electrical contacts.

SUMMARY

The present invention is particularly adapted to be embodied in an electrical connector having two separate sections. A breech lock is provided whereby merely rotating the lock a fraction of a turn (i.e., $\frac{1}{4}$ to $\frac{1}{3}$ of a revolution) secures or releases the two sections together. Toggle means such as an overcenter spring (i.e., a conical disc spring) biases the two sections and the electrical contacts therein into position. A high lead thread is effective to move the electrical contacts into or out of engagement. When the breech lock is rotated the overcenter or Belleville spring drives all of the electrical contacts together or separates them with a "toggle" or snap action.

An elongated central core is provided on one section so as to slide into the other section. This is effective to align the sections as they are mated and to reinforce them against any bending moments. A "short pin" is provided for one of the contacts so as to provide a remote mate monitor test circuit. This is effective to assure the connector is fully mated.

DRAWINGS

Figure 2:
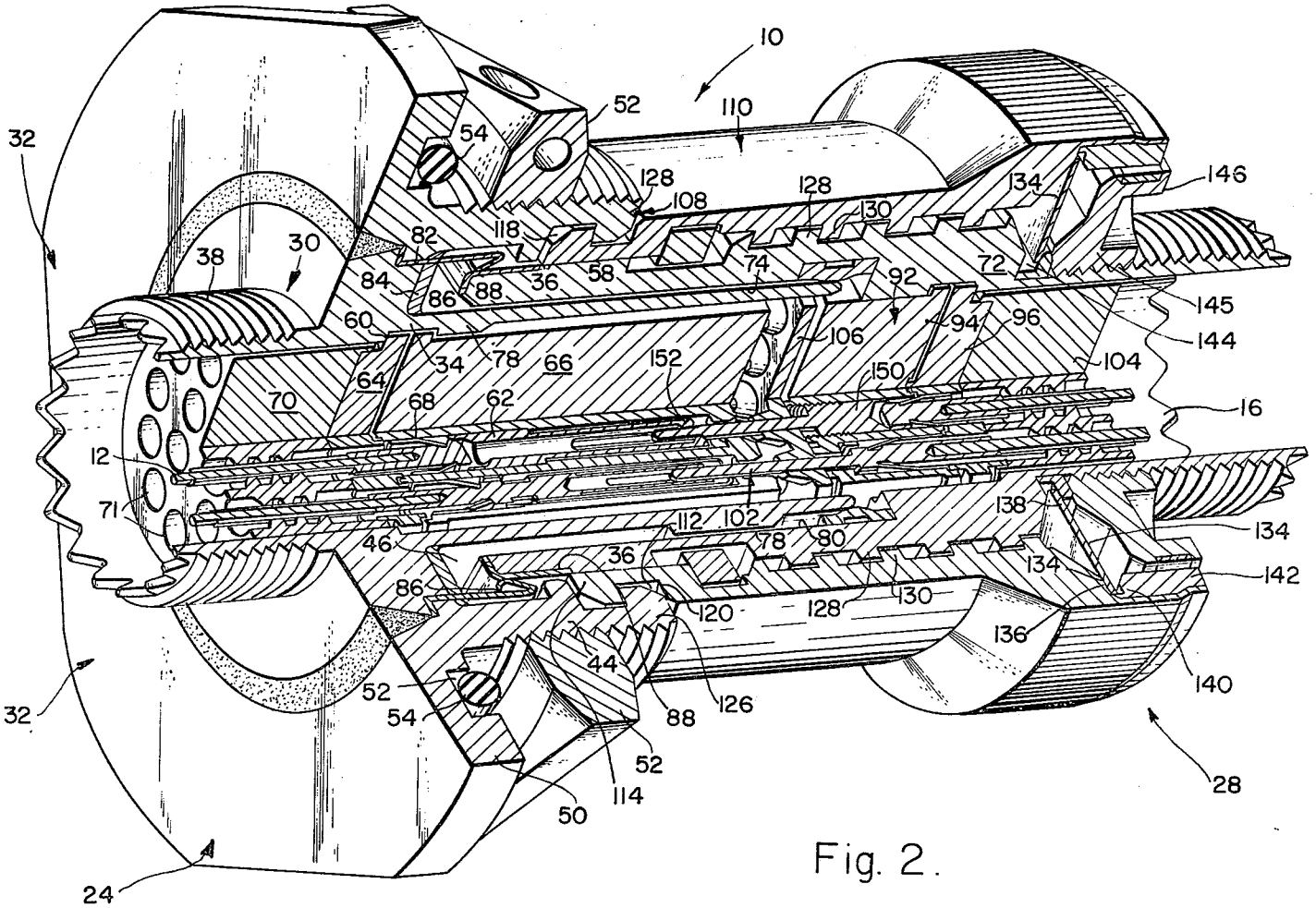
Figure 3:
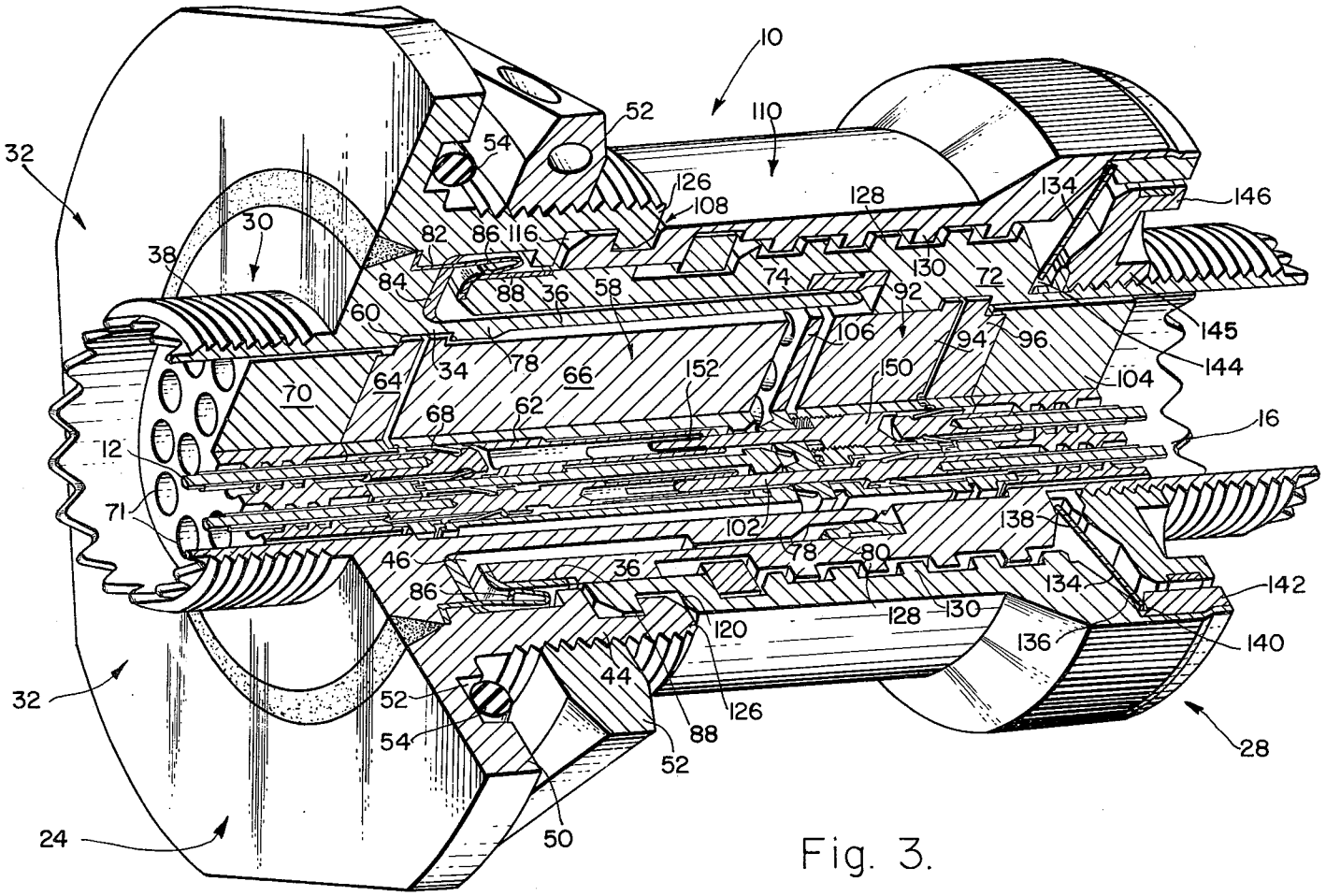
Figure 4:
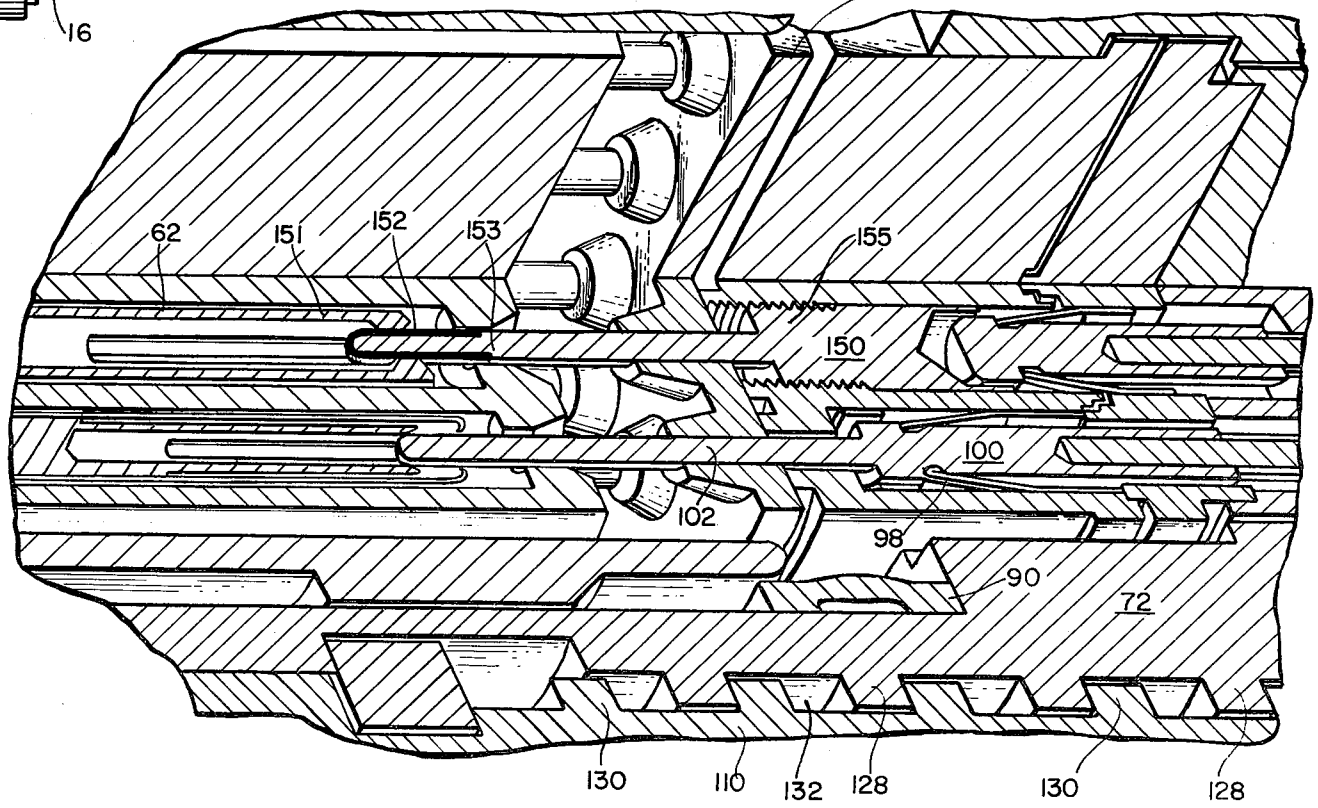
Figure 5:
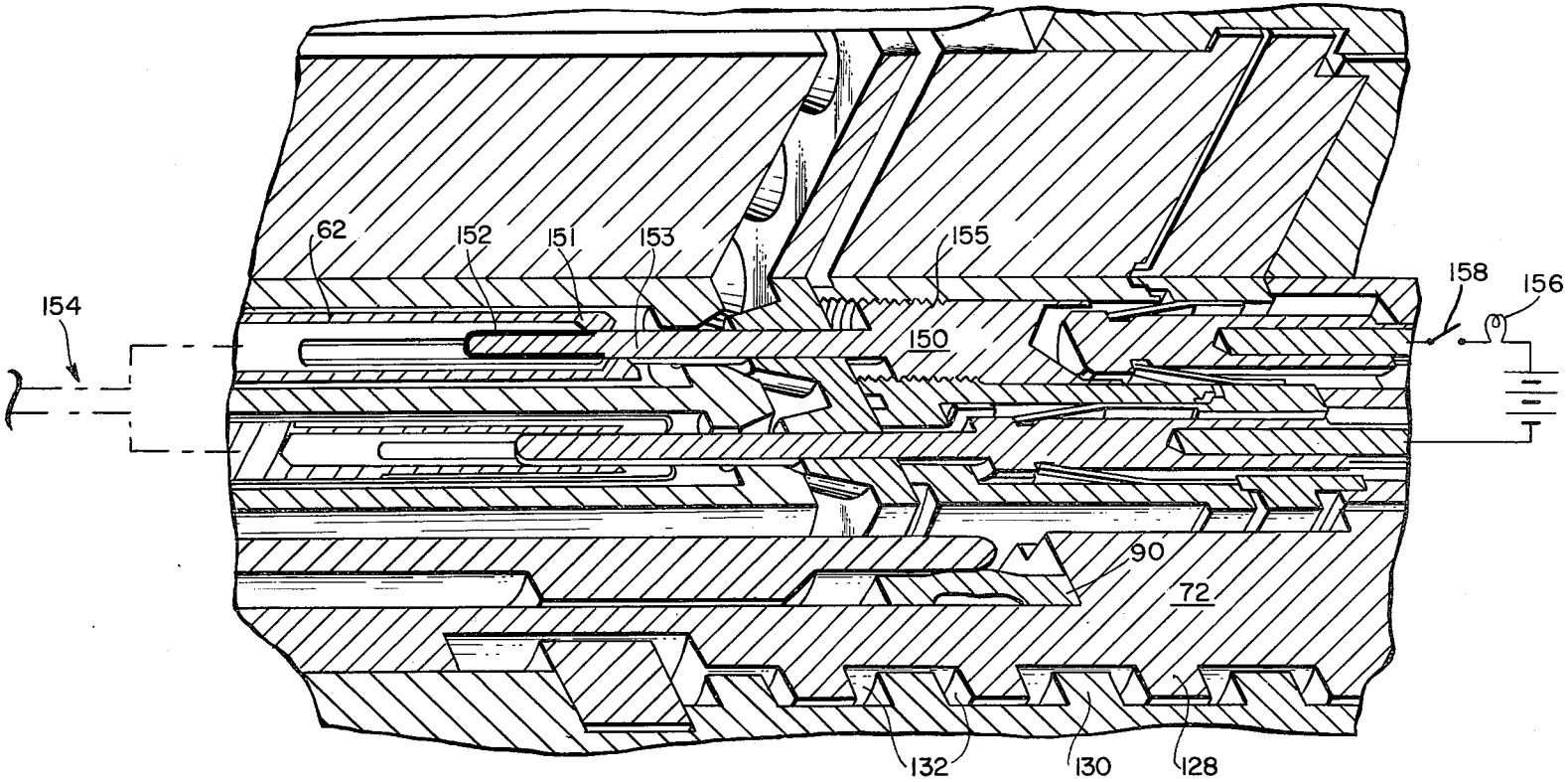

FIG. 1 is a perspective view of a connector embodying one form of the present invention, said connector being in the unmated condition and having a portion thereof broken away to more clearly show a portion of the interior thereof, FIG. 2 is a broken away perspective view similar to FIG. 1 but showing the connector in a transitional position between the fully mated and unmated conditions, FIG. 3 is a broken away perspective view similar to FIG. 1 but showing the connector in the fully mated condition, FIG. 4 is a fragmentary, broken away perspective view on a greatly enlarged scale, of a portion of the connector while it is in the unmated condition of FIG. 1, and FIG. 5 is a fragmentary, broken away perspective view similar to FIG. 5 but while the connector is in the fully mated condition of FIG. 3.

Figure 6:
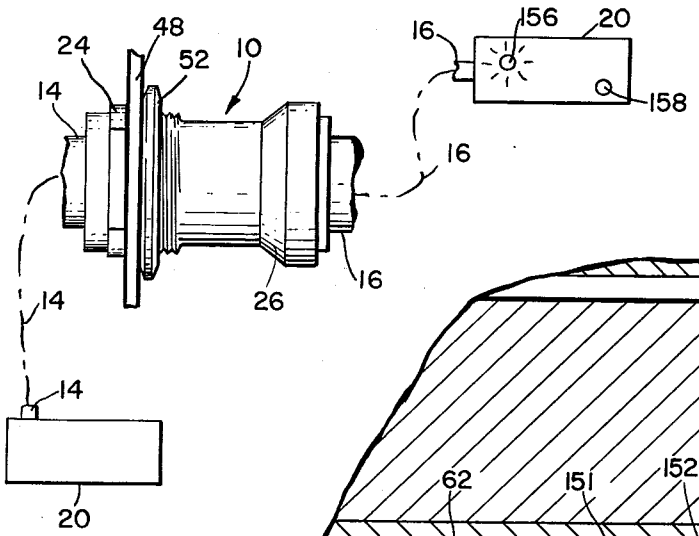

FIG. 6 is a block diagram of a system utilizing the connector of FIG. 1.

DESCRIPTION

The present invention is particularly adapted to be embodied in an electrical connector 10 for interconnecting the various individual wires or conductors 12 in a first cable 14 with the corresponding wires or conductors 16 in a second cable 18. The first cable 14 may lead to any suitable electrical or electronic equipment 20. Similarly, the second cable 18 may lead to a second electrical or electronic equipment 22.

The connector 10 includes two separate parts or sections 24 and 26 which may be readily mated or unmated, whereby the two cables 14 and 18 may be readily mechanically and electrically interconnected and/or readily mechanically and electrically disconnected.

The receptacle section 24 includes a receptacle insert housing 28. The exact shape, size, configuration, etc., of the insert housing 28 is dependent upon the intended use for the connector 10.

In the present instance the receptacle housing 28 is a two part structure which includes an inner shell 30 and a mounting collar 32. The inner shell 30 includes a core 34 having an elongated, generally cylindrical barrel 36. The exterior of the rear portion of the core 34 has threads 38 for receiving a conventional back shell 40. The back shell 40 is an electrically conductive member which is mechanically and electrically connected to the armor and/or RF shielding on the cable 14. Accordingly, by threading the back shell 40 onto the shell 30 the RF shielding on the cable 14 is attached to the connector 10.

A flange 42 projects radially outwardly from the core 34 adjacent to the inner end of the threads 38. The mounting collar 32 fits onto the flange 42 and is secured thereto by means of a circumferential weld. The mounting collar 32 includes a sleeve 44 which projects axially forward. This sleeve 44 is concentric with the barrel 36 whereby it leaves an annular open space 46 around the exterior of the barrel 36.

In the present instance the receptacle section 24 is intended to be permanently mounted in a fixed position on a bulkhead 48. Accordingly, the mounting collar 32 includes a rim 50 which extends radially outwardly beyond the sleeve 44. This rim 50 is adapted to engage the backside of the bulkhead 48. Fastening means such as a locking nut 52 is threaded onto the exterior of the sleeve 44. When the locking nut 52 is threaded toward the rim 50 the bulkhead 48 will be clamped therebetween. Normally an annular groove 53 is machined into the face of the rim 50 to receive an O-ring 54. When the receptacle section 24 is secured in position on the bulkhead 48 this O-ring 54 will seal the opening.

Although the insert housing 28 may be made of any desired material, it is preferably electrically conductive and fabricated from a light-weight metal such as aluminum. Since the mounting collar 32 is preferably welded in position it is desirable to use a weldable aluminum alloy such as 5086.

The shell 30 includes a passage 56 which extends axially therethrough from one end to the other. Although this passage 56 is substantially cylindrical, for purposes of discussion it will be considered as being subdivided into two separate segments.

The first segment includes an insulating structure 58 disposed in the passage 56 for retaining the receptacle electrical contacts in position within shell 30. The insulating structure 58 includes a breech lock 60 for securing it in position in the passage 56. To permanently install the structure 58 in the passage 56, a suitable cement or bonding material is applied to the structure 58. It is then forced into the passage 56 and rotated to engage the breech lock 60. This will securely anchor the structure 58 in position.

The number of electrical contacts, their size and construction, etc., are dependent upon the number of conductors in the cables 14 and 18, the nature of the electrical currents, etc. However, in the present instance a separate opening is provided for each contact 62: Each of the openings extends axially through the insulating structure 58 from one end to the other. Each of the electrical wires in the cable 14 extends into the rear of one of the passages. Each of the conductor wires 16 is then individually connected to one of the individual electrical contacts 62.

Although the insulating structure 58 may be a single member, in order to facilitate the mounting of the contacts 62, etc., it has been found advantageous to employ two separate inserts 64 and 66 which are permanently bonded together to form a single monolithic structure. The use of two inserts 64 and 66 allows a contact retainer 68 to be trapped in each passage between the two inserts 64 and 66. More particularly, before the inserts 64 and 66 are bonded together a contact retainer 68 is placed in each passage in one of the inserts. When the two inserts 64 and 66 are bonded together the retainers 68 are anchored in the passages between the inserts 64 and 66. Each of the retainers 68 includes a spring finger or resilient detent through which an electrical contact 62 may pass in one direction.

As a result, when a contact 62 attached to the end of a wire conductor 12 is pushed into the passage from the rear, the contact 62 will be trapped and locked in position in the passage by the retainer 68. Although the contacts 62 may be of any variety, in this embodiment the contacts in the receptacle section 24 are of the so-called socket variety. These contacts 62 include long passages adapted to mate with complementary long slender pin contacts in the plug section 26.

In order to prevent dirt, dust, moisture, etc., entering into the connector 10, it is desirable to provide some form of protection such as a seal. This is particularly true with regards to the rear of the receptacle section 24 where the cable 14 and/or the individual wire conductor 16 from the cable 14 enter. In this embodiment this is accomplished by means of a resilient seal 70 in the rear or second segment of the passage 56. The seal 70 which is normally a resilient material such as a silicone rubber, etc., engages the rear of the insulating structure 58.

The individual wires or conductors 16 pass through small openings 71 in the seal 70. This is effective to prevent dirt, dust, moisture, etc., from entering into the interior of the connector 10. To assist in this sealing action, a backing or pressure plate may be provided on the rear of the seal 70.

Since the seal 70 is made of a compressible material such as a silicone rubber, if an axial pressure is imposed on the seal 70 the material therein will tend to flow radially in all directions. As a consequence, it will be forced into intimate contact with the passage 56, the conductors 12, etc. This in turn insures an intimate, high pressure contact against all of the surfaces whereby a high degree of sealing is insured.

As indicated above, the receptacle section 24 is normally secured to the bulkhead 48. Accordingly, the barrel 36 of the shell 30 projects beyond the sleeve 44 at substantially right angles to the plane of the bulkhead 48. As indicated above, the exterior of the barrel 36 has a generally cylindrical surface whereby the plug section 26 may fit over the barrel 36 when the two sections 24 and 26 are mated.

The plug section 26 includes a plug insert housing 72 having a passage 74 extending axially therethrough. The passage 74 may be of a generally cylindrical configuration with an essentially uniform diameter. However, in the present embodiment for purposes of discussion, it may be considered as subdivided into at least three separate regions or segments.

The front or forward segment of the passage 74 has an enlarged diameter and is adapted to fit snugly over the exterior of the barrel 36 of the receptacle shell 30. The middle segment is separated from the forward segment by a forwardly facing radial shoulder and is adapted to have an insulating structure 92 disposed therein. The rear segment has a diameter approximately equal to that of the middle segment and is adapted to contain a sealing structure.

As indicated above, the front or forward segment of the passage 74 is adapted to fit over the exterior of the barrel 36 on the shell 30. The length of this segment is approximately equal to the length of the barrel 36. It is desirable there be a minimum amount of clearance between the exterior surface of the barrel 36 and the inside surface of passage 74. This clearance should be just adequate to allow a free sliding action between the mating parts without any binding or jamming occurring.

With a minimum clearance of this nature, as the barrel 36 enters into the passage 74 the receptacle insert housing 28 and the plug insert housing 72 will be accurately axially aligned with each other. Because of this axially elongated mating of the two members 28 and 72 it will be impossible for any significant canting or misalignment to occur between the two segments 24 and 26. Also, the mechanical engagement of these parts over this extended length will provide an increased leverage that will strongly oppose any bending moments which may be imposed upon the assembled mated sections.

The exterior of the barrel 36 and the interior of the passage 74 may be milled or otherwise cut out to form a plurality of keys and/or key ways. These keys 78 and key ways 80 may be asynmetrically arranged whereby they can only mate in one unique angular orientation. This is effective to polarize the mating of the two sections 24 and 26. As a consequence, the electrical contacts 62 in the receptacle section 24 will always mate with the respective contacts in the plug section 26.

The cables 14 and 18 normally employ some form of electrically conductive outer jacket which acts as an RF shielding for the cable. In order to preserve this RF shielding, the jackets or shielding on the cables 14 and 18 should be coupled together by means of the connector 10. In other words, in this type of electrical connector 10, it is essential there be some form of highly effective electrical grounding or RF shielding for interconnecting the two cables 14 and 18.

However, it has been found that at the higher frequencies normally encountered with a connector 10 of this type, the currents normally circulate on the surface. Accordingly, even though the housings 28 and 72 are electrically conductive, any surface irregularities, etc., tend to act as wave traps, etc. These in turn creates a large impedance which materially degrades the effectiveness of the coupling and shielding.

In order to overcome this difficulty, an RF coupling is included in the connector 10. This coupling includes an annular RF member 82 which is anchored to the receptacle housing 28. Normally it is welded into position when the mounting collar 32 and shell 30 are welded together. It has been found desirable to provide some form of moisture sealant 84 around the root of the RF member 82. This may be formed by merely pouring a small amount of resin into position and allowing it to cure.

The RF member 82 includes a plurality of resilient fingers 86. These are positioned to bear on the exterior of the plug insert housing 72. An electrically conductive contact 88 such as silver or gold may be provided on the outside where the fingers 86 mate.

The fingers 86 are resiliently radially deformable to insure a uniform contact pressure at all times. This pressure and electrical contact is maintained at all times even though the axial position of the insert housing 72 may vary.

A resilient seal such as an O-ring or elastomeric collar 90 may be provided at the inner end of the segment. This collar 90 is positioned to bear on the exterior of the barrel 36 to assist in the alignment and sealing.

The second or middle segment of the passage 74 is separated from the first segment by the forwardly facing radial shoulder. The inside diameter of the middle segment is substantially the same as the diameter of the passage 56 in the barrel 36 of the receptacle housing 28.

An insulating structure 92 is provided in the middle segment of the passage. The insulating structure 92 may be generally similar to the first insulating structure 58. In this embodiment it includes a front insert 94 and a rear insert 96 having aligned passages therethrough. The contact retainers 98 are mounted in the individual passages so as to be trapped between the two inserts 94 and 96. The electrical contacts 100 are retained in position within the passages by the contact retainers 98.

Although these contacts 100 may be of any desired variety, they preferably mate with the contacts 62 in the receptacle section 24. In the present instance since each of the contacts 62 in the receptacle section 24 is of the socket variety, the contacts 100 are of the complementary pin variety. Each contact includes a long slender pin 102 that fits into the hollow socket contact 62 in the receptacle section 24.

Each socket contact 62 has an opening therein which is aligned with an opening on the front face of the insert 66. When the receptacle section 24 and the plug section 26 are fully mated, the pins 102 project from the face of the insert 94 and pass through the openings into the sockets. This is, of course, effective to maintain an electrically conductive path between the respective contacts.

The third or rear section of the passage includes a resilient seal 104 which may be essentially identical to the seal 70 in the receptacle section. The seal 104 includes a plurality of small passages for the individual wires or conductors in the second cable 18. These conductors extend through the openings and are connected to the contacts 100. It can thus be seen that the two seals 70 and 104 are effective to seal the opposite ends of the connector 10 to prevent the entrance of dirt, moisture, etc.

In addition to the two end seals 70 and 104, it is very desirable to provide some form of interface sealing between the mating faces on the two inserts 66 and 94. In the present instance this interface seal 106 is in the form of a thin wafer of an elastomeric material such as silicone rubber, etc. The wafer or seal 106 includes a large number of small openings which allow the pins 102 to extend therethrough. It has been found desirable for the pins 102 to be a snug fit in these openings whereby the wafer seal 106 will normally remain on the face of the plug section 26.

When the two sections 24 and 26 are fully mated, the thin interface seal 106 is compressed between the faces of the two inserts 66 and 94. As a result, the elastomeric material in the seal 106 tends to flow into and against all of the surfaces and thereby provides a complete and effective sealing action.

A small tapered projection may be provided on the seal 106 around each pin. These projections extend into complementary tapered recesses in the face of the insert. The mating and compressing together of these tapered surfaces will further enhance the interface sealing action.

It can be seen when the plug section 26 is fully mated with the receptacle section 24, all of the wires 12 and 16, contacts 62 and 100, etc., are completely enclosed within a protected region which is sealed against the entrance of dirt, moisture, etc., and is surrounded by a continuous electrically conductive path extending from the shielding on one cable 14 all the way to the shielding on the other cable 16. This is very effective to fully protect the contacts 62 and 100 and provide a very high degree of shielding against any stray electromagnetic energy which may be incident upon the connector 10.

As indicated above, when the receptacle section 24 and he plug section 26 are mated, the front segment of the passage in the plug insert housing 72 fits snugly over the exterior of the barrel 36 on the receptacle insert housing 28. As indicated above, this mating action is preferably "polarized" by the keys 78 and key ways 80 on the barrel 36 and housing 72. As a consequence, the two sections 24 and 26 can only mate in one unique angular orientation and this in turn insures a proper continuity between the various contacts 62 and 100.

It may be seen, the portion of the connector 10 described so far is an operative connector in that it is effective to interconnect the electrical conductors 12 in one cable 14 with the conductors 16 in the other cable 18. However, the two sections 24 and 26 can be readily mechanically and electrically separated. Accordingly, means may be provided for securely locking the plug section 26 onto the receptacle section 24 after the two sections have been properly mated. Although any suitable fastening means may be employed, in this embodiment a so-called breech lock 108 is provided for expeditiously securing and releasing the two sections 24 and 26.

The present breech lock 108 includes a plug retainer or coupling nut 110 disposed upon the exterior of the plug insert housing 72. One end of the coupling nut 110 includes some form of retaining means for engaging and locking onto the receptacle shell 30.

In the present embodiment an annular recess or channel 112 is cut into the end of the coupling nut 110. This channel 112 extends completely around the nut 110 whereby a circumferential flange 114 is formed. Normally the channel 112 is cut to form a face 113 that is radial to the axis, i.e., the face 113 has no axial slope nor any spiral pitch.

Several openings or key ways 116 are cut axially through the flange 114. This in turn leaves a plurality of circumferentially spaced lands or shoulders 118. The inside surface of the lands or shoulders 118 are defined by the face 113.

The inside of the sleeve 44 on the receptacle shell 30 is under cut to form a second annular recess or channel 120 whereby a radially inwardly directed flange 122 is formed on the shell 30. This flange 122 is dimensioned to be moveably disposed in the channel 112 and conversely the channel 120 is dimensioned to receive the flange 114. A plurality of key ways 124 are cut axially through the flange 122 at various circumferential points to form a plurality of lands 126. These key ways 124 are positioned and dimensioned to accommodate the lands 118 on the coupling nut 110.

It may be seen that the inside surfaces of the two sets of lands 118 and 126 have faces that are truely radial, i.e., they do not have any axial slope or spiral pitch. The faces on the two sets of lands 118 and 126 are arranged fully mated with each other. As a consequence, the lands 118 on the coupling nut 110 may pass freely through the key ways 124 cut into the flange 122 on the inside of the sleeve 44. When the coupling nut 110 is rotated, the lands 118 will pass behind the lands 126.

Normally the number, dimensions and positions, etc., of the lands 126 are arranged such that only a small amount of rotation is required to move the lands 126 completely behind the lands 118. By way of example, it has been found that a rotation of about $\frac{1}{4}$ to about $\frac{1}{3}$ of a turn is well suited for this purpose.

It should be noted that the breech lock 108 is not required to perform any keying or polarizing function. This is all performed by the mating keys on the barrel 36 and the insert housing 72. As a consequence, the lands 118 and 126 may be positioned symmetrically whereby there will not be any asymmetric or skew forces on the breech lock 108. This is effective to avoid any sort of bending moment between the two sections 24 and 26.

The interior of the plug coupling nut 110 and the exterior of the plug insert housing 72 include matching screw threads 128 and 130. Preferably the threads 128 and 130 are comparatively large or gross and have essentially square cross sections.

The spaces between the adjacent turns of the threads 128 and 130 are preferably considerably wider than the width of the threads 128 and 130. This provides a substantial opening or clearance space 132 between the mating threads whereby a predetermined amount of lost motion is present. This allows the coupling nut 110 to move axially along the insert housing 72.

It may thus be seen that as the coupling nut 110 rotates about housing 72, the housing 72 will be moved axially through the opening nut 110 by the action of the threads 128 and 130. However, at the same time the insert housing 72 may shift axially within the coupling nut 110 by the amount of the lost motion 132 present in the threads 128 and 130.

The threads 128 and 130 are what might be referred to as a fast power thread, i.e., the threads preferably have a very high lead. As a result, a small amount of relative rotation will cause a very large amount of axial movement. More particularly, when the coupling nut 110 is rotated by about $\frac{1}{4}$ to $\frac{1}{3}$ of a revolution, the threads 128 and 130 will force the insert housing 72 to move axially through the coupling nut 110 from a fully retracted position to a fully extended position. The amount of rotation of the coupling nut 110 to accomplish this is approximately equal to or slightly more than is required to fully engage the breech lock 108.

In addition to the threads 128 and 130 or as an alternative thereto, it is desirable to provide some form of biasing means to assist in moving the insert housing 72 within the coupling nut 110. This may be a spring or similar device for biasing the moving parts of the connector into the desired positions.

The biasing action of the spring is preferably of an over-center variety, i.e., it is effective to produce a "snap" or toggle action. Depending upon the condition of the spring, it tends to bias the parts in either one direction or the other direction. Moreover, the reversal of the direction of the force is substantially instantaneous whereby a snap or toggle action is created.

In the present instance this is accomplished by means of a conical spring or Belleville washer 134 which has been found particularly well suited for this purpose. Such a spring 134 is essentially a conical washer having an outer rim 136 and an inner edge 138 that forms a round opening. When such a spring 134 is unconfined it has a frusto conical shape and is in state of equilibrium.

As the inner edge 138 of the spring 134 is forced axially toward the plane of the outer rim 136 the axial force builds up to a maximum level and then gradually decreases. When the outer rim 136 and the inner edge 138 are all in the same plane (i.e., the spring is perfectly flat) the inner edge exerts no force in either direction. The spring 134 is in what can be described as a critical equilibrium, (i.e., the slightest force in either direction will move the inner edge 138 out of the plane of the outer rim 136). If the inner edge 138 continues to move past the center position the force reverses its direction. As the deflection increases the force builds up to a maximum negative level and then returns to zero when the inner edge 138 reaches the other extreme position.

The Belleville spring 134 is coupled between the coupling nut 110 and insert housing 72. The outer rim 136 is trapped between a shoulder 140 on the inside of the nut 110 and a locking collar 142 which is secured inside of the end of the nut 110. The inner edge 138 is trapped between a shoulder 144 on the housing 72 and a retainer clamp 145. The retainer clamp 145 is secured in position by an end ring 146 threaded onto the exterior of the insert housing 72.

The biasing forces of the spring 134 described above are those of a normal or unrestrained Belleville washer.

When the spring 134 is embodied in the connector 10 its action is preferably modified slightly from the foregoing. If the inner edge 138 and the outer rim 136 are firmly clamped to their respective parts whereby there is no slack or play between the spring 134 and the adjacent parts, the foregoing type of action will prevail. However, in the present instance a small amount of "play" or lost motion is provided between the inner edge 138 and the insert housing 72 and/or between the outer rim 136 and the coupling nut 110.

This lost motion in the mounting of the spring 134, allows the spring 134 to "twist" slightly within its mountings as it passes over dead center. This in effect creates a certain amount of hysteresis in the deflection of the spring 134. Moreover, it also causes a virtually instantaneous build-up in the force of the spring. This greatly enhances the snap action or toggle effect.

The snapping action of the spring 134 abruptly "throws" the housing across the clearance space in the threads. This can be readily heard and felt when the connector 10 is mated or unmated. As a result, the operator can readily feel and hear when the mating or unmating action has been accomplished.

In order to more fully understand the operation of the connector 10 and its advantages, first assume that the two sections 24 and 26 of the connector 10 are separated and it is desired to mate them. In this event the plug section 26 will be in essentially the condition shown in FIG. 1. More particularly, the insert housing 72 will be retracted into the interior of the coupling nut 110 and the inner edge 138 of the Belleville spring 134 will be deflected rearwardly.

To mate the two sections 24 and 26, the plug section 26 is first brought up to the receptacle section 24. It is then initially partially mated essentially as seen in FIG. 1. To accomplish this initial mating, the end of the plug insert housing 72 slides axially along the exterior of the barrel 36 of the receptacle housing 28. Since exterior of the barrel 36 and the interior of the housing 72 have complementary keys 78 and key ways 80, this mating is unique or polarized, i.e., they will only mate in one angular orientation. As a consequence, each of the pin contacts 100 in the plug section 26 will beaccurately aligned with a respective socket contact 62 in the receptacle section 24.

The two sliding or mating surfaces have a close or snug fit. As a consequence, as the housing 72 slides over the barrel 36 the two housing 28 and 72 will very quickly become axially aligned with each other and maintained fully aligned. In other words, as long as the first segment of the passage 74 is fitted around the barrel 36 it is impossible for the two housings 28 and 72 to become canted or cocked relative to each other.

Since the end of the housing 72 projects beyond the ends of the pin 102, this axial alignment is created before any of the pins 102 can enter any of the passages into the insert 66. This is, of course, effective to insure a proper alignment and mating of the contacts 62 and 100.

The mating action is continued until the plug section 26 is pushed into the receptacle section 24 as far as it will go. Normally this movement is limited by the end of the coupling nut 110 contacting a radial flange 148 on the sleeve 44 or the end of the sleeve 44 engaging the coupling nut 110 essentially as shown in FIG. 1. It may be seen that in this partially mated condition the ends of the pin contacts 100 have just barely entered into the ends of the passages. The ends of the pin contacts 100 may or may not have electrically engaged the ends of the socket contacts 62.

It may be seen that if the ends of the pin contacts 100 do in fact engage the ends of the socket contacts 62 an electrical continuity may be created between the two cables 14 and 16. However, since the two sections 24 and 26 are not securely locked together, this is what may be described as a false mating. That is, the plug section 26 may readily separate from the receptacle section 24. As a safe guard to check against a false mating of the connector 10, a "short pin" or "remote mate monitor" contact 150 may be provided. As explained more fully subsequently in connection with the description of FIGS. 4 and 5, this short pin contact 150 cannot establish full electrical contact until the connector 10 has been fully mated and mechanically locked in the fully mated condition.

As may be seen in FIG. 1 although the plug coupling nut 110 is pushed inwardly as far as it will go axially, the breech lock 108 is not set and the two sections 24 and 26 can still be readily pulled apart. However, the lands or shoulders 126 on the inside of the sleeve 44 are disposed in alignment with the channel 112 on the end of the housing 72. They have also moved axially inwardly beyond the lands or shoulders 118 formed on the end of the housing 72.

To fully complete the mating of the connector sections 24 and 26, the coupling nut 110 is next rotated in the mate direction. During this rotation the structure of the connector will first pass through the configuration shown in FIG. 2.

The first event which occurs is the circumferential movement of the lands or shoulders 118 along the channel 120 and behind the lands or shoulders 126. As soon as the land 118 moves behind the land 126 the two sections 24 and 26 are locked together, (i.e., the two sections 24 and 26 cannot be separated by merely pulling axially upon them).

It should be noted that the mating surfaces or faces on the lands or shoulders 118 and 126 are all in a common transverse plane and there is no spiral surface. There is no threading action when these faces engage. As a consequence, the mating of these faces and the closing of the breech lock 108 does not create any axial force which would tend to force the two sections 24 and 26 together or in any way move them axially,. This, of course, makes the turning of the coupling nut 110 very easy and simple. It should be noted that although a certain amount of torque is required to turn the coupling nut 110, there is no component in this torque which forces the sections 24 and 26 together.

As the rotation of the coupling nut 110 commences, the front surface of the threds 130 on the inside of the coupling nut 110 rides along the back surface of the threads 128 on the outside of the housing 72. As this threading or screw action progresses it moves the plug insert housing 72 axially through the coupling nut 110. This causes the insert housing 72 and the various other moving parts of the plug section 26 contained within the insert housing 72 to advance toward their corresponding counterparts in the receptacle section 24. More particularly, the insulating structure 92 advances toward the insulating structure 58 whereby the pins 102 slide into the socket contacts 62.

At the same time as the insert housing 72 is advancing through the coupling nut 110, the inside edge 138 of the spring 134 is forced to move axially with housing 72. At the same time the outer rim of the spring is anchored to coupling nut 110 by the clamping ring 142. As a result, the spring 134 is progressively distorted until it reaches the centered position as seen in FIG. 2.

Up to this point the force of the spring 134 has opposed the movement of the housng 72 and the front side of the threads 130 have been riding along the backside of the threads 128. The axial force of the spring 134 is effective to retain these two surfaces axially loaded and in sliding contact. As a result, all of the lost motion or clearance space is behind the threads.

Accordingly, up to this point the angular rotation of the coupling nut 110 directly and positively controls the axial position of the insert housing 72 and the contacts 100, etc., therein. It should also be noted that up to this point the axial force of the spring 134 tends to bias the insulating structure 92, contacts 100, etc., away from the receptacle section 24 and thereby bises the contacts 100 in the unmated direction.

Since the spring 134 is now in a critical state of equilibrium, the slightest amount of additional turning of the coupling nut 110 causes the spring 134 to move over-center. When this occurs, the inner edge 138 of the spring 134 instantly "snaps" over-center and into the position seen in FIG. 3. Because of the lost motion at the outer rim 136 and/or the inner edge 138, the spring 134 instantly snaps over-center and into the position shown in FIG. 3.

As the inner edge 138 of the spring 134 moves forward it exerts a very substantial force on the insert housing 72. This drives the housing 72 and other moving parts of the plug section 26 axially toward the receptacle section 24. At this point the loading on the threads 128 and 130 reverses its direction. Because of the lost motion between the threads 128 and 130, the housing 72, inserts 94 and 96, contacts 100, etc., are suddenly and forcefully driven forward. This causes the pin contacts 100 to be driven fully into the socket contacts 62. In fact, the forward motion continues until the interface seal 106 is tightly compressed between the two inserts 66 and 94.

In addition, since the force from the spring 134 is now assisting the rotation of the coupling nut 110 it will be quickly twisted as far as it can go whereby the breech lock 108 becomes fully and completely engaged. The operator will readily feel this completion of the twist and hear the "click" of the spring 134 moving over-center. As a result, he will quicly recognize that the connector 10 is fully mated. Equally important he will also know that the connector 10 is not fully mated until he feels and hears this action.

As has been described before and as may be seen from FIG. 3 there is a considerable amount of lost motion or spacing 132 and between the mating threads 128 and 130. In fact, the amount of lost motion plus the amount of advance or lead of the thread exceeds the amount of travel or "throw" of the inner edge 138 of the spring 134, i.e., the distance the inner edge 138 travels when it moves from one extreme position to the other extreme position. Because of this play or lost motion in the mating action between the threads, the insert housing 72 "floats" inside of the coupling nut 110. The threads 138 and 130 do really control the position of the housing 72 and accordingly, the spring 134 is free to bias the interior parts of the connector 10 together. This resilient biasing action of the spring 134 imposes a compressive load on the interface seal 106 and all of the other parts of the connector 10.

The axial, compession force produced by the spring 134 is adequate to maintain a suitable compressive load on this structure and in particular on the interface seal 106. Irrespective of the normal variations in the dimension of the parts of the connector 10 and/or the shrinking of the interface seal 106 or its taking a permanent set, etc., the spring 134 will always continue to exert a substantially constant axial force on all of the parts. Accordingly, an optimum mating action is created and maintained at all times.

As previously mentioned, when the connector sections 24 and 26 are partially mated as shown in FIGS. 1 and 2, the "short pin" or "remote mate monitor" contact 150 will not establish an electrical contact with its respective socket contact 62. This pin contact 150 may actually be shorter than the other pins 100. However, as may best be seen in FIGS. 4 and 5 in this embodiment the pin contact 150 is actually the same length as all of the other pin contacts 100. However, the end of the pin contact includes a layer 152 of insulation on its trip. As a result, even though the tip of the pin 150 may be mechanically positioned within the socket contact 62 as shown in FIG. 4, there is no electrical contact.

After the Belleville spring 134 has moved overcenter and driven all of the movable parts into the full mated position, the insulated tip 152 will have moved into the socket 62 as best seen in FIG. 5. At this point the electrically active end 151 of the socket 62 will have ridden up on to the shank 153 of the pin 150 whereby an electrical continuous path is created across the connector 10. The head of the contact 150 may have threads 155 whereby the axial position of the insulated tip 152 may be axially adjusted. This allows the position of the contact 150 to be very precisely controlled whereby the instant of the electrical engagement is readily adjustable. The length of the insulated tip 152 and the position of the contact are all arranged to prevent electrical engagement when the spring 134 is in the unmated position (FIGS. 1 and 4) and to insure electrical engagement when the spring 134 has snapped over-center into the mated position (FIGS. 3 and 5).

It will thus be seen that the only time an electrical continuity can be created through this "short pin" or "remote mate monitor" contact 150 is when the breech lock 108 is fully engaged, the spring 134 has passed overcenter and all of the various parts of the connector 10 are fully electrically and mechanically locked in position. As a result, a test or monitor circuit 154 may be connected to the socket 62 and pin contact 150. This circuit may include an audible alarm or a visual indicator such as a light 156. This test circuit 154 may be manually actuated by depressing the button 158 or it may be automatic. This will be effective to indicate at some remote location whether or not the connector 10 is fully electrically and mechanically mated.

Very frequently the connector 10 is subjected to very substantial and severe vibrations and/or accelerations. These vibrations may be of such a magnitude they would cause a malfunction of a prior art connector. For example, they might cause one or more of the electrical contacts to separate and/or the two sections of the connector to be released.

This cannot happen with the present connector 10 because of the combined action of the threads 128 and 130 and spring 134. The vibration and accelerations encountered may cause some axial movement of the housing insert 72. This is normally well within the range of the lost motion 132 in the threads 128 and 130 and the resilient deflections of the spring 134. As a result, there will be no separation. If under unusually severe circumstances the deflections exceed the amount of lost motion 132 the threads 128 and 130 will actually engage each other. However, because of their high pitch and the forces of the spring 134 a torque is created which will "screw" the connector 10 back into the fully mated condition. As a result, there is no way the connector 10 can separate or malfunction as long as the spring 134 does not go over-center. Because of the mechanical advantages, etc., this is virtually impossible except by a deliberate turning of the coupling nut 110.

The interaction of the elongated barrel 36 and the insert housing 72 provides a very rigid structure. This is effective to maintain the two sections 24 and 26 axially aligned at all times and to oppose any bending movements which may be imposed on the connector 10 as a result of any side loading.

The mating lands 118 and 126 on the coupling nut 110 and the sleeve 44 are an integral part of the breech lock 108 and are effective to maintain the two sections 24 and 26 securely locked together. The mating lands 118 and 126 are disposed as close as practical to the outside of the connector. This places them at a maximum radius from the center line of the connector 10.

As a result of the increased lever arm this provides a very strong structure which effectively opposes any bending. Also, because of the large radius the circumference is long. This provides a large surface area on the mating faces even though the height of the lands may be small. This, of course, drastically reduces the stress on the mating faces and the wear thereon.

When the two sections 24 and 26 are fully mated substantially as shown in FIG. 3 they are securely locked together by the breech lock 108. The spring 134 retains the various parts such as the contacts, interface seal, etc., all properly compressed and mated irrespective of any forces from vibrations, acceleration, etc. If it is desired to separate the two sections 24 and 26 from each other, the plug coupling nut 110 is rotated in the unmated direction. During the initial phase of this rotation the threads 130 on the coupling nut 110 will move axially through the open space until it picks up the surface on the backside of the threads 128. Until the threads 130 comes into engagement with the surface on the threads 128, there is no movement of the insert housing 72.

During this initial phase of the rotation the spring 134 is being distorted whereby the rotation of the coupling nut 110 is opposed by the spring 134. Accordingly, if the coupling nut 110, etc., is accidentally rotated (for example, by acceleration or vibratory force, etc.) the spring 134 opposes the forces and tends to return the coupling nut 110 to its original position. Also even though there may be a significant amount of rotation of the coupling nut 110, because of the lost motion in the threads 128 and 130, etc., the spring 134 is effective to still maintain the contacts, interface seal, etc., all fully compressed and mated.

After the coupling nut 110 has rotated far enough to overcome the lost motion in the threads 128 and 130, further rotation of the coupling nut 110 will move the inner edge 138 of the spring 134 toward the critically balanced position shown in FIG. 2. At this point the screw action produced by the mating threads has started the insulating structure 92 moving and at least partially released the interface seal 106 and separated the contacts 100 from the contacts 62.

The slightest additional rotation of the coupling nut 110 will cause the spring 134 to snap over-center and into the position shown in FIG. 1, At this instance the spring 134 reverses the direction of the axial force and tends to now drive the moving parts in the opposite direction whereby they are fully separated and there is little or no axial force on the connector 10 and in particular on the mating surfaces of the breech lock 108.

The further and final rotation of the coupling nut 110 will fully open the breech lock 108 and move the lands or shoulder 118 from the backside of the lands or shoulders 126. Accordingly, at this point the plug section 26 may be freely pulled axially and become completely separated from the receptacle section 24.

It may be seen that a very simple and effective connector 10 has been provided. Because of the breech lock 108 and the spring 134 the connector 10 can be very simply and quickly mated or unmated. Morevover, it is either fully mechanically and electrically mated or unmated. There can be no false matings such as the connector being mechanically mated and electrically unmated or vice versa. Because of the unique relationship between the dimensions of the throw of the toggle action spring 134 and the "short pin" contact 150 it is possible to remotely monitor whether the connector 10 is fully mated or unmated. Moreover, as long as the connector 10 is mated it cannot be accidentally unmated or any of the contacts separated.

We claim:

1. An electrical connector including the combination of a plug section, a first set of electrical contacts on said plug section, a receptacle section adapted to mate with said plug section, a second set of electrical contacts on said receptacle section, the contacts in each set of electrical contacts being adapted to electrically engage a corresponding contact in the other set to provide mated pairs of contacts, means for urging said sections into full electrical and locked engagement comprising spring means operable to advance one of said sets of contacts into full electrical contact with the other set of contacts, said spring means biasing said section carrying said one set of said contacts into full locked engagement with the other sections, and monitor means for indicating the position of said plug and receptacle sections in such full electrical and mechanically locked engagement, said monitor means comprising one of said mated pairs of contacts serving as monitoring contacts and having non-electrically conductive contacting surfaces mechanically engagable when said remaining sets of contacts are initially mated and electrically conductive surfaces electrically engageable only upon said sections being positioned in full mechanically locked engagement by said spring means with all of the sets of contacts on one of said sections being fully locked into contacting engagement with all of the sets of contacts on the other of said sections, said monitor means indicating such full electrical and mechanically locked engagement only when all of said sets of contacts are in full mated contacting engagement.

2. In a connector as stated in claim 1 including a monitor device connected to said monitoring contacts and providing a signal upon full electrical and locking engagement of said sections.

3. An electrical connector as stated in claim 1 including means for adjusting said monitoring contacts to restrict electrical engagement of said monitoring contacts to full mated and locked position of said sections.

* * * * *